United States Patent [19]

Ratelband

[11] Patent Number: 5,020,513

[45] Date of Patent: Jun. 4, 1991

[54] SCREEN ADAPTED TO BE PLACED IN FRONT OF A HEARTH FIRE OR OTHER SOURCE OF RADIANT HEAT

[76] Inventor: Johannes B. Ratelband, Haydnstraat 27, 6661 BS Elst, Netherlands

[21] Appl. No.: 498,546

[22] Filed: Mar. 26, 1990

[30] Foreign Application Priority Data

Mar. 28, 1989 [NL] Netherlands ..... 8900763

[51] Int. Cl.[5] ..... F24B 1/192

[52] U.S. Cl. ..... 126/544; 126/500; 126/553; 160/DIG. 9

[58] Field of Search ..... 126/544, 553, 500; 160/DIG. 9

[56] References Cited

U.S. PATENT DOCUMENTS 4,304,216 12/1981 Ratelband ..... 126/544 X
4,412,524 11/1983 Ratelband ..... 126/544 X
4,616,628 10/1986 Ratelband ..... 126/544 X

*Primary Examiner*—Larry Jones
*Attorney, Agent, or Firm*—Watson, Cole, Grindle & Watson

[57] ABSTRACT

A screen, e.g. fire-guard is provided for heating a room by convection using the heat from a radiation heat source, e.g. an open hearth fire, a gas-fire or an electric radiant heater, and when the heat source is an open hearth fire for use as a fire-guard preventing sparks or other small particles of combustion from entering the room in which the fire is located. The screen includes a row of at least with their upper portions spaced apart vertical pipes having each at or near their lower end an inlet opening and at or near their upper end an outlet opening for air sucked from the room by the chimney-action of the warm pipes. The pipes of at least one pair of adjacent pipes of the screen are hingedly interconnected for the rotation of one of these pipes about the longitudinal axis of the other pipe thereof by coupling and clamping means.

3 Claims, 1 Drawing Sheet

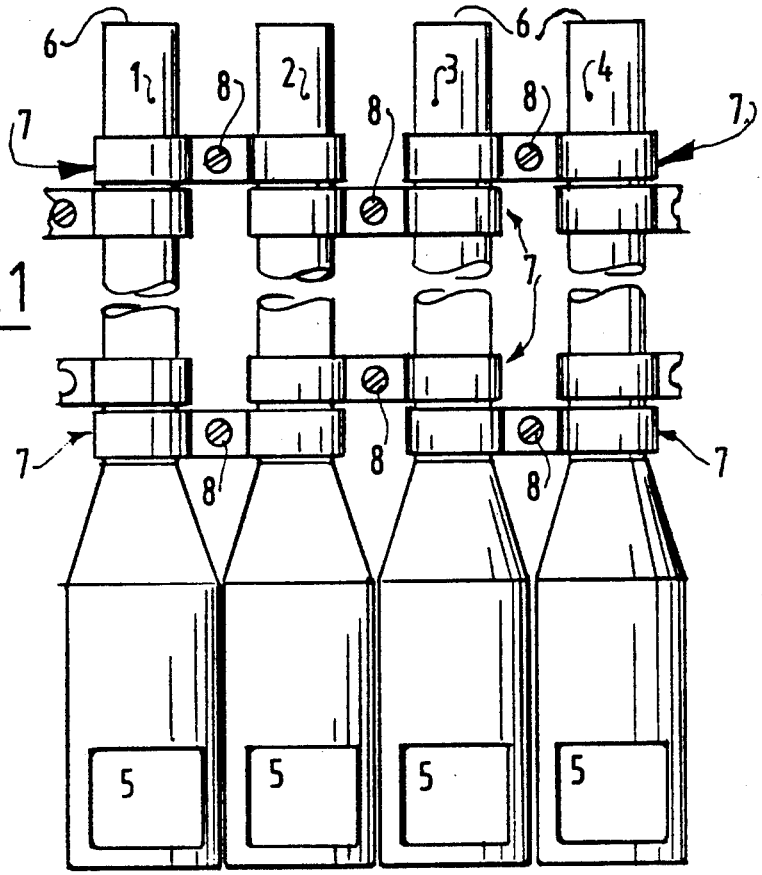
FIG.1
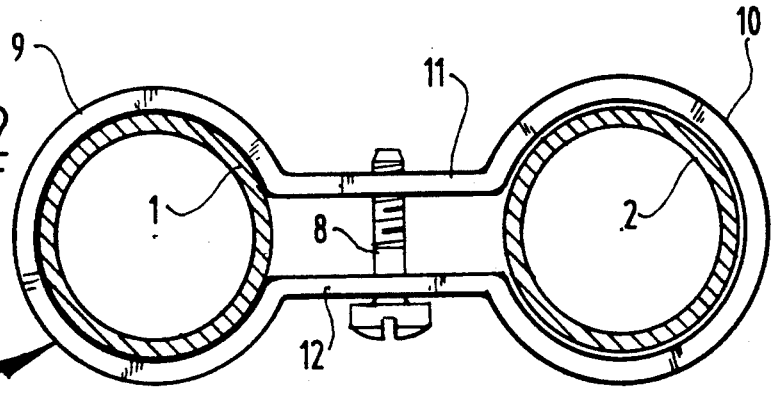
FIG.2
FIG.3
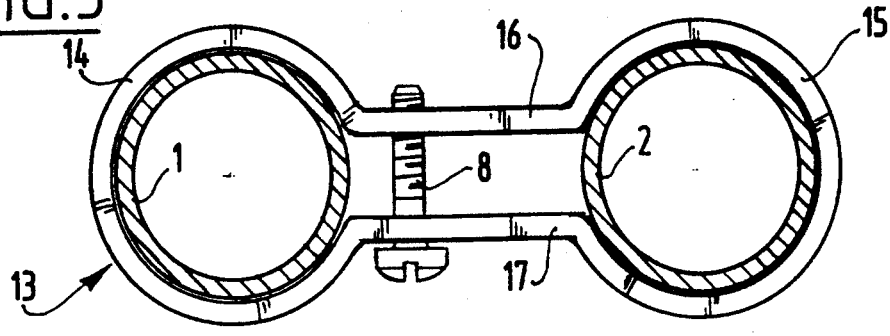

SCREEN ADAPTED TO BE PLACED IN FRONT OF A HEARTH FIRE OR OTHER SOURCE OF RADIANT HEAT

BACKGROUND OF THE INVENTION

It is a known fact that for heating a room, convection heat, due to its more even distribution of the heat over the space of the room to be heated, is much more efficient and agreeable than radiant heat. That is why in front of a radiant heater, such as an open hearth fire, a radiating gas fire, an electric radiant heater or other source of radiant heat, screens have already been placed which are well adapted for such a radiant to convection heat conversion. Generally, such screens consist of a row of interconnected (at least with their upper portions), spaced apart vertical pipes having at or near their lower end an inlet opening and at or near their upper end an outlet opening. When such pipes are heated by the radiant heat received on their outer surfaces the air inside them is heated and flows as a result of the chimney-action of the pipes upwards, so that continuously cool air is sucked from the room through the low inlet openings into the pipes and hot air is discharged through the high outlet openings of the pipes back into the room where it is distributed by circulation.

However, screens of this kind have to satisfy several requirements. They must be easily manageable and quickly heatable. This means that the pipes and the coupling means for their interconnection must be constructed as light as possible, and in any case the pipes which contribute to the major part of the weight of the screen must have a very thin wall (some tenths of a millimeter). But such pipes are easily damaged so that great care must be taken with the manner in which the pipes are interconnected. Furthermore, these screens can be an obstacle in the room, so that they must be adapted to be put easily away and stored. This requirement can be satisfied by making the screen foldable, which requires the provision of a hinge joint between the pipes of at least one pair but preferably of several or all pairs of adjacent pipes of the screen. When the pipes have a very thin wall much care must be taken with the manner in which the hinge joint is constructed and is attached to the pipes.

Now, a screen, e.g. a fire-guard used also as a screen to prevent sparks or other small particles of combustion from entering the room in which it is placed in front of an open hearth fire, of the above-mentioned construction and satisfying the noted requirements has been disclosed in European patent specification EP-A-0 123 342. This known screen comprises a row of interconnected) at least for a part of their length), horizontally spaced apart, round pipes which extend vertically, are placed side by side and have each at or near their lower end an opening to admit air from and at or near their upper end an opening to discharge air into the room to be heated by the source of heat. The two pipes of at least one pair of adjacent pipes of this known screen are so interconnected by a hinge joint as to ensure that one pipe of the pair is adapted to swing with its longitudinal axis in a circular cylinder surface about the longitudinal axis of the other pipe of the pair. This hinge joint consists of a splitted ring and connecting parts interconnecting the ring parts and also of means for so clamping the connecting parts towards one another, as to guarantee that in the active end condition of the clamping means one ring part of the coupling member is firmly clamped on one pipe, but the other ring part embraces the other pipe in a manner as to allow still a relative rotation of the ring part and the other pipe.

In addition to the fact that a screen of this type satisfies the above-mentioned requirements, it has the advantage that it is continually cooled by the current of air in the pipes, so that one will not burn oneself when touching it.

SUMMARY OF THE INVENTION

According to the invention the object aimed at is to provide a screen, e.g. a fire-guard, having the features mentioned above of the screen disclosed in the noted European patent application EP-A-0123342, but wherein the construction of the hinge joint(s) between the pipes of one or more pairs of adjacent pipes is much improved. From FIGS. 5 and 6 of this European patent specification the coupling member of the or each hinge joint of the known screen appears to consist of two individual parts interconnected by the screws which are also meant for the clamping action. In practice it has been found that this known hinge joint requires for its manufacture and assembly relatively much material, many working hours and considerable accuracy and as a result thereof is relatively costly. In contrast with this known construction of the coupling member, the improvement of said member consists in accordance with the present invention in that the ring parts and the connecting parts of the coupling member form together an endless closed loop in one piece of material in the shape of a bent strip, bar or wire. Such a coupling member can be mass produced in a simple and cheap manner and can be mounted easily on the respective pipes of the screen in production.

For the production of this improved coupling member a method is recommended which comprises the steps that first a tube with suitable wall thickness and a cross-sectional profile in the shape of the required endless loop of the coupling member is formed and thereafter, in the next or the opposite order of succession, holes for at least one clamping bolt or screw per coupling member are made in the portions meant for the connecting parts and thereupon pieces, of which the width corresponds with the height of the loop of the coupling member are cut from the tube. This method can be carried out in continuous working with great speed. The tube may be drawn through one or more moulds with suitable through-going openings and mandrels or be extruded, but it is also possible for that purpose to start with a tube having a cross-section of standard profile, for instance a circular profile, and to roll the tube till the cross-sectional profile has attained the desired shape.

It is observed that from FIGS. 2 and 3 of the mentioned European patent specification EP-Al-0 123 342, coupling members for the hinge joint are known which also are in one piece. These coupling members are connected firmly with one pipe of the respective pair of pipes by a clamping screw or by a shrunk connection. However, as already has been stated, the thickness of the wall of the pipes is so small (not more than several tenths of a millimeter) that the fixing by means of a screw easily leads to serious damage of the pipe and the fixing by shrinking requires a pipe with a considerable greater thickness of its wall. These known coupling members consisting of one piece appear actually to be unfit for use with pipes required for the meant screens, e.g. fire-guards. Their use for pipes of the meant type would require so much time, care and accuracy that the price of the screen would become prohibitive.

Should the coupling member according to the invention be so constructed that the inner diameter of one ring part thereof is equal to or, in order to facilitate the sliding thereof on the pipe, is slightly larger than the outer diameter of a pipe and the inner diameter of the other ring part is somewhat larger than that of the first mentioned ring part, the clamping means may then engage the connecting parts midway between the ring parts. In that case it can sometimes be difficult to see directly on which pipe of the screen the narrower and on which pipe the wider ring part of the coupling member must be slid. Therefore it may be advantageous in some cases, for instance when there is sufficient space between the ring parts, to so construct the coupling member as to allow the clamping means to act on the connecting parts of the member in a place which is nearer to one than to the other ring part of the member. In that case the diameters of the ring parts may even be equal. The place of the clamping means and not the diameter of the ring parts then indicates in which way the coupling member must be mounted.

BRIEF DESCRIPTION OF THE DRAWINGS

FIG. 1 is a front view of a portion of a screen, of which the pipes of a plurality of pairs of adjacent pipes are hingedly interconnected in the way according to the invention, FIG. 2 is on an enlarged scale a cross-sectional view of the pipes of such a pair and a top view of the coupling members which hingedly interconnects the pipes, and FIG. 3 is a cross-sectional view and a top view as shown in FIG. 2 of pipes and a variant of the coupling member, respectively.

DETAILED DESCRIPTION OF THE DRAWINGS

FIG. 1 shows four hingedly interconnected, round vertical pipes 1,2,3,4 of a screen according to the invention, on, these pipes each having an inlet opening 5 near its lower end and a discharge opening 6 near its upper end.

The hinge joint between the two pipes of each pair of directly pipes consists of a coupling member 7 and a clamping means in the shape of a self-tapping screw 8. The coupling member 7 is formed as shown in FIG. 2.

This coupling member consists of a closed endless strip in one piece which is thick in comparison with the very small wall thickness of the pipes and has the shape of a first ring part 9 always embracing the left hand pipe of a pair of pipes through an angle of about 300° C., a second ring part 10 and connecting parts 11,12 which interconnect in pairs the ends of the ring part 9,10. The clamping screw 8 is passed through a loosely fitting hole of the connecting part 12 and screwed in an originally too narrow hole of the connecting part 11. In FIG. 2 as well as in FIG. 3 the clamping screw 8 has not yet been screwed on. In this unloaded condition of the coupling member 7 the inner diameter of the left hand ring part 9 is equal to or slightly larger than the outer diameter of the upper portion of the pipes, of which the lower portion has a larger diameter. Thus the coupling member 7 is only just adapted to be slid with the ring part 9 on the upper portion of the pipes. In unloaded condition the right hand ring part 10 has an inner diameter which is larger than that of the left hand ring part 9, due to which the ring part 10 has a fit with noticeable clearance on the upper pipe portion.

When the coupling member 7 has been slid on two pipes extending side by side, the wider lower most pipe portions contact or nearly contact each other. If then the screw 8 be screwed on, the ring part 9 becomes firmly clamped on the left hand pipe, but the clamping action of the ring part 10 on the right hand pipe is so slight that relative rotation of the coupling member 7 and the left hand pipe clamped tightly thereon about the longitudinal axis of the right hand pipe remains easily possible.

The variant of the coupling member according to FIG. 3 consists in that the endless coupling member 13 made in one piece has two equal ring parts 14,15 which in unloaded condition are too wide and are interconnected by connecting parts 16,17. However, in this case the clamping screw 8 approaches the left hand ring part 14 as much as possible, in such a manner that when the screw is screwed on, the left hand ring part 14 is clamped on the left hand pipe portion with considerably greater force than the right hand ring part 15 is clamped on the right hand pipe portion. If the diameter of the ring parts and those of the pipes and also the lengths of the connecting parts 16,17 and the resilience of the strip material of the coupling member are well chosen, also in this case the effect occurs that the left hand pipe will be firmly embraced by the coupling member 13, whereas rotation between the member and the right hand pipe remains possible.

It is observed that the length of the connecting parts is defined by the required horizontal distance between the upper portions of the pipes forming together the screen. Consequently, it is possible that the connecting parts become so short that lateral displacement of the clamping screw 8 has hardly any effect. In that case the coupling member according to FIG. 2 must be used.

What is claimed is:

1. In a screen adapted to be placed between a radiant heat source and a room to be heated, said screen comprising a plurality of vertically-extending pipes which are positioned in a horizontal row, each pipe defining a vertical axis and having a lower end and an upper end, each pipe providing an air inlet opening at or near said lower end thereof and an air outlet opening at or near said upper end thereof, and a hinge joint for connecting a pair of adjacent pipes so that a first pipe of said pair can be swung around a second pipe of said pair with the vertical axis of said first pipe following the surface of an imaginary circular cylinder about the vertical axis of said second pipe, the improvement wherein said hinge joint comprises a one-piece coupling member and a clamping means, said one-piece coupling member consisting of an endless strip-like element which is shaped to define a first split ring part for positioning around said first pipe, a second split ring part for positioning around said second pipe and two connecting parts extending between said first and second split ring parts, and wherein said clamping means engages said two connecting parts so as to cause said first split ring part to firmly grip said first pipe while said second split ring part remains rotatably positioned around said second pipe.

2. A screen as claimed in claim 1, wherein said clamping means engages said two connecting parts midway between said first and second split ring parts.

3. A screen as claimed in claim 1, wherein said clamping means engages said two connecting parts at a location closer to said first split ring part than said second split ring part.

* * * * *